United States Patent [19]

Grocock et al.

[11] Patent Number: 4,813,259

[45] Date of Patent: Mar. 21, 1989

[54] ROLLING MILL

[75] Inventors: Peter G. Grocock, Bournemouth; Philip F. Round, Wimborne, both of United Kingdom

[73] Assignee: Davy McKee (Poole) Limited, Poole, United Kingdom

[21] Appl. No.: 96,022

[22] PCT Filed: Nov. 20, 1986

[86] PCT No.: PCT/GB86/00710

§ 371 Date: Jul. 21, 1987

§ 102(e) Date: Jul. 21, 1987

[87] PCT Pub. No.: WO87/03227

PCT Pub. Date: Jun. 4, 1987

[30] Foreign Application Priority Data

Nov. 22, 1985 [GB] United Kingdom ..... 8528848

[51] Int. Cl.[4] ..... B21B 31/18; B21B 31/32

[52] U.S. Cl. ..... 72/245; 72/243; 72/247

[58] Field of Search ..... 72/247, 245, 243, 241, 72/20

[56] References Cited

U.S. PATENT DOCUMENTS

| | | | |
|---|---|---|---|
| 3,307,386 | 3/1967 | Ward et al. | 72/241 |
| 3,498,098 | 3/1970 | Bournez et al. | 72/245 |
| 3,534,577 | 10/1970 | Fernbach | 72/245 |
| 3,555,872 | 1/1971 | Bournez et al. | 72/245 |
| 4,491,005 | 1/1985 | Kimura et al. | 72/201 |
| 4,499,748 | 2/1985 | Nihei et al. | 72/243 X |
| 4,543,810 | 10/1985 | Stoy et al. | 72/245 |
| 4,615,202 | 10/1986 | Stoy et al. | 72/245 |

FOREIGN PATENT DOCUMENTS

| | | | |
|---|---|---|---|
| 0202910 | 12/1982 | Japan | 72/247 |
| 0157510 | 9/1983 | Japan | 72/243 |
| 0066906 | 4/1984 | Japan | 72/241 |
| 0068103 | 4/1985 | Japan | 72/245 |
| 2064700 | 6/1981 | United Kingdom . | |

*Primary Examiner*—Robert L. Spruill
*Assistant Examiner*—Steven B. Katz
*Attorney, Agent, or Firm*—Foley & Lardner, Schwartz, Jeffery, Schwaab, Mack, Blumenthal & Evans

[57] ABSTRACT

A rolling mill stand includes a pair of spaced apart housings each defining a window having a pair of blocks projecting therein from opposite sides of the housing. A pair of horizontal work rolls are arranged one above the other and are supported in bearing chock assemblies located in the housing windows. The rolls are displaceable in the direction of their length. Roll bending forces may be applied at the ends of the rolls by hydraulic rams acting vertically between the blocks and the bearing chock assemblies. The outer end of each ram, where it engages the bearing chock assembly, includes a body which is rotatably mounted on the ram and permits relative movement between the ram and the bearing chock assembly when the rolls are displaced in the direction of their length.

6 Claims, 3 Drawing Sheets

ROLLING MILL

BACKGROUND OF THE INVENTION

This invention relates to rolling mills having provision for applying roll bending forces to the work rolls of the mill.

It is known to apply bending forces to the bearing chock assemblies mounted at opposite ends of the work rolls of a mill by positioning fluid operated rams in parts of the mill housing which project into the mill window. These parts may be integral with the housing or may take the form of blocks which are secured to opposite walls of the housing. In these blocks, rams are located such that the piston of one ram projects from the top of the block and is engageable with the underside of a part of the bearing chock assembly on one roll and another piston projects from the underside of the block and bears against an upwardly disposed surface on the bearing chock assembly of the other roll. When the bearing chock assemblies are only free to move vertically towards and away from each other, there are no particular problems because the line of action of the rams is also vertical. In certain applications, however, it is desirable that the work rolls should be displaceable axially and, thus, in addition to moving vertically, the bearing chock assemblies at the ends of the work rolls must also be free to move axially of the roll thereby moving in the direction at right angles to the line of action of the fluid operated rams. This can result in damage being caused to the rams, particularly if an attempt is made to move the rolls axially while the rams are energised to apply bending forces to the rolls by way of the bearing chock assemblies.

SUMMARY OF THE INVENTION

It is an object of the present invention to overcome this difficulty.

The present invention resides in a rolling mill stand comprising a housing structure; a pair of horizontal work rolls arranged one above the other and each supported at their ends in bearing chock assemblies which are located in the housing structure; means for displacing the rolls in the direction of their length; roll bearing means for applying roll bending forces at the ends of the rolls, said roll bending means comprising hydraulic rams acting vertically between the housing structure and the bearing chock assemblies and wherein the outer end of each ram where it engages the bearing chock assembly is constituted by a rotatable body which permits relative movement between the ram and the bearing chock assembly in the direction of movement of the bearing chock assembly when the rolls are displaced in the direction of their length.

By making the outer end of each ram in the form of a rotatable body, the force is applied between the ram and the chock, even when there is relative axial movement between the chock and the block in which the ram is located. The axial movement causes the rotatable body to rotate in the housing in which it is located, the housing forming part of the piston of the ram.

The rotatably body is conveniently a sphere in the form of a steel ball which is partly located in a recess in the end of the piston and the ball projects through an aperture in a retaining cover fitted to the end of the piston.

In an alternative arrangement, a roller is pivotally mounted in the outer end of the ram with part of the periphery of the roller projecting beyond the housing which retains the roller in the piston. The axis of rotation of the roller is such as to readily enable the roller to rotate about this axis when there is relative movement between the roller and the chock against which it bears in the axial direction of the roll supported by the chock.

It is usual that in each block there are a pair of bending ram groups arranged symmetrically on opposite sides of the centre line of the bearing between the end of the work roll and the chock against which the bending groups abut. Each group may consist of a single ram or a pair of rams situated in side-by-side relation. When the roll, and hence, its bearing chock assembly is fixed relative to the rams, there are no particular difficulties so long as the ram groups are symmetrical with the centre line of the bearing between the roll and the chock assembly. However, when the roll is displaceable axially with respect to the block in which the bearing ram groups are positioned, out of balance forces will exist when axial displacement occurs. In this type of rolling mill, whether or not there is a rotatable body at the end of each ram, the pressures exerted by the groups of bending rams in each block are controlled to maintain the following relationship:

$$P_1/P_2=(L/S-1$$

where $P_1$ and $P_2$ are the pressures generated by the respective bending ram groups, L is the distance between the centres of these two groups, and S is the offset of one bearing group from the axial centre of the work roll bearing.

BRIEF DESCRIPTION OF THE DRAWINGS

In order that the invention may be more readily understood, it will now be described, by way of example only, with reference to the accompanying drawings in which.

DETAILED DESCRIPTION OF THE PREFERRED EMBODIMENT

Figure 1:
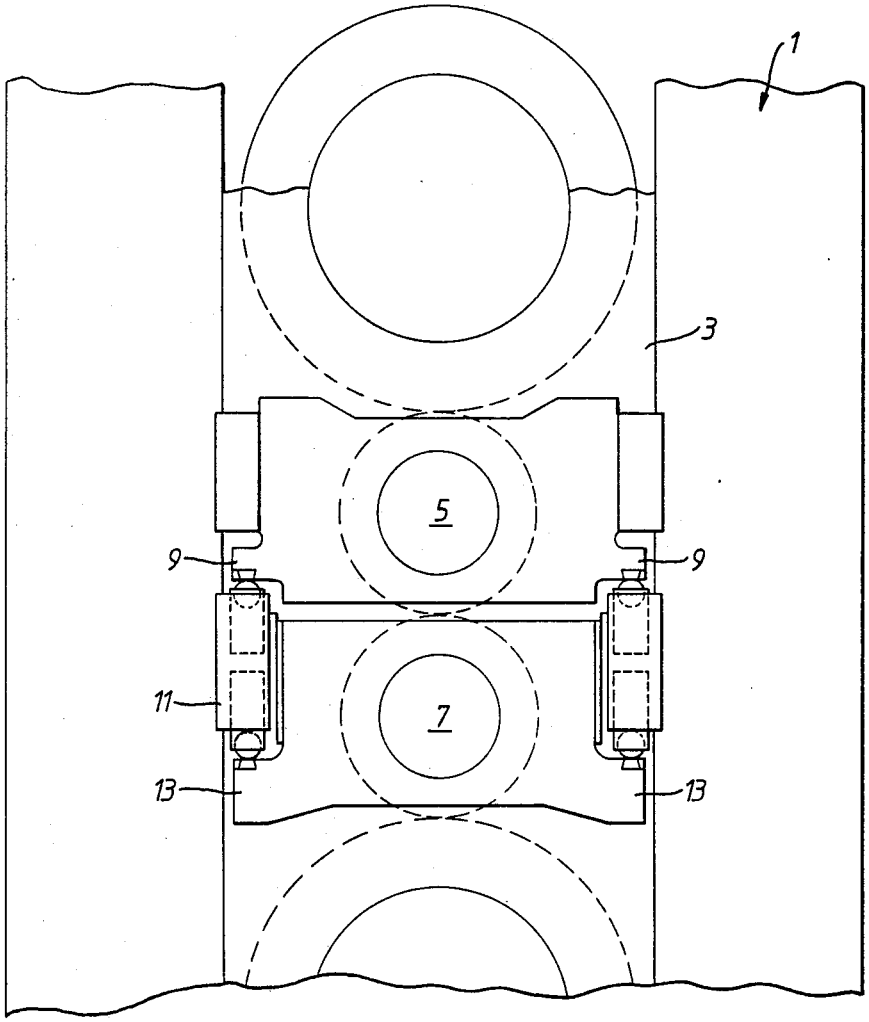
FIG. 1 is an end view of part of a rolling mill showing the position of the bending rams.

Referring to FIG. 1, a mill housing 1 defines a window 3 containing a pair of chocks 5, 7 mounted at the corresponding end of a pair of upper and lower work rolls, respectively. The chock 5 has a pair of outwardly extending wings 9 which are located above blocks 11 located on opposite walls of the housing and the chock 7 has a pair of wings 13 which project below the blocks. In each of the blocks there a number of bending ram groups which act against the wings 9, 13, respectively, in order to apply bending forces to the work rolls.

Figure 2:
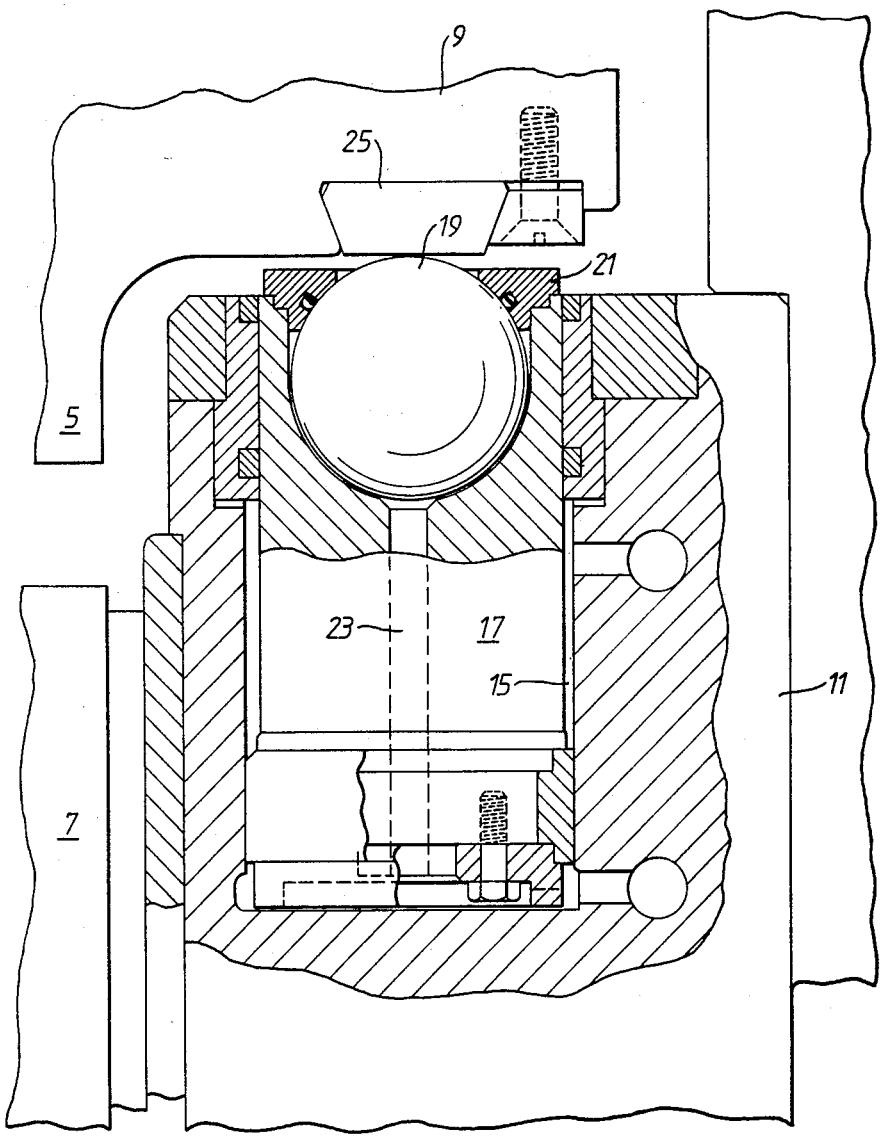
FIG. 2 is a section through a bending ram.

As shown in FIG. 2, one of the bending rams comprises a cylinder 15 formed in the block 11 with a double-acting piston 17 displaceable within the cylinder. The outer end of this piston is recessed to contain a rotatable body in the form of a metal sphere 19 which is held in position in the recess by an apertured cover 21 through which a part of the periphery of the sphere projects. Lubricant is supplied to the surface of the sphere 19 by way of an axial feed tube 23 formed in the piston 17.

The sphere 19 bears against a wear plate 25 let into the wing 9 of the top chock 5.

Figure 3:
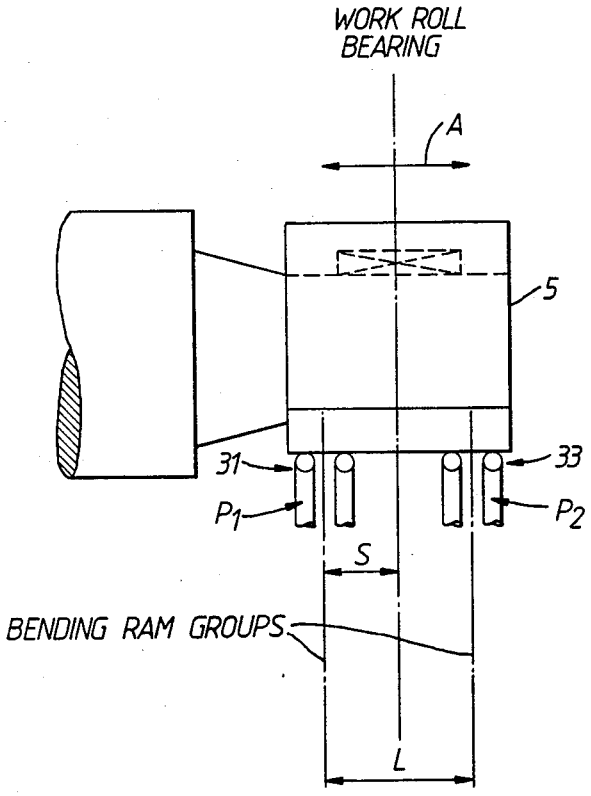
FIG. 3 is a sketch indicating the relative positions of the bending ram groups and the forces produced by them.

FIG. 3 shows a work roll having a bearing chock assembly 5 at one end. Against the underside of this chock there are a number of bending rams which are engageable with the underside of the chock in order to apply bending forces to the work roll. The bending rams are arranged in two groups, referred to as group 31 and group 33, respectively. These groups are located symmetrically about the centre line of the work roll bearing with the centre line of each group being separated by a distance S from the centre line of the bearing and with the centre lines of the bearings separated by a distance L. In the position shown, the bending forces $P_1$, $P_2$ generated by the bending rams groups when they are energised would be arranged to be equal in the symmetrical position shown in the figure. When, however, the roll is shifted axially, the bending ram groups are no longer symmetrical with respect to the centre line of the work roll bearing and, in order to prevent misaligned forces being applied to the bearing chock, the pressure generated by the rams is controlled to maintain the following relationship:

$$P_1/P_2=(L/S)-1$$

L where $P_1$ and $P_2$ are the pressures generated by the respective bending ram groups, L is the distance between the centres of these two groups, and S is the offset of one bearing group from the centre line of the work roll bearing.

Signals can be obtained from a transducer mounted on the actuator for displacing the work rolls in order to provide a signal representative of the offset S and the pressure of the fluids supplied to the bending ram groups is adjusted accordingly.

What is claimed is:

1. A rolling mill stand comprising:

a housing structure including a pair of spaced apart housings each defining a window having a pair of blocks projecting therein from opposite sides of the housing;

a pair of horizontal work rolls arranged one above the other and each supported at its ends in bearing chock assemblies which are located in the housing windows;

means for displacing the rolls in the direction of their length;

means for applying roll bending forces at the ends of the rolls, said means comprising hydraulic rams acting vertically between the blocks and the bearing chock assemblies; and a body rotatably mounted on an outer end of each ram, where it engages a bearing chock assembly, which permits relative movement between the ram and the bearing chock assembly when the rolls are displaced in the direction of their length.

2. A rolling mill stand as claimed in claim 1, in which each ram comprises a cylinder defined by one of said blocks, a piston displaceable in the cylinder and an outer end of said piston, where it engages a bearing chock assembly, includes a sphere which is rotatably mounted on the piston.

3. A rolling mill stand as claimed in claim 11, in which the sphere is partly located in a recess in the end of the piston and projects through an aperture in a retaining cover fitted to the end of the piston.

4. A rolling mill stand as claimed in claim 1, in which each ram comprises a cylinder defined by one of said blocks, a piston displaceable in the cylinder and an outer end of said piston, where it engages a bearing chock assembly, includes a roller which is rotatably mounted on the piston.

5. A rolling mill stand as claimed in claim 1, in which in each window there are a plurality of hydraulic rams acting vertically between each block and each bearing chock assembly, said plurality of rams being arranged in two groups with the groups arranged one behind the other in the direction of axial movement of the rolls.

6. A rolling mill stand as claimed in claim 13, in which the pressures exerted by the groups of bending rams in each block are controlled to maintain the following relationships:

$$P_1/P_2=(L/S-1$$

where $P_1$and $P_2$are the pressures generated by the respective bending ram groups, L is the distance between the centres of the two groups, and S is the offset of one group of bending rams from the axial centre of the work roll bearing.

* * * * *